US006547203B1

(12) United States Patent
Willard

(10) Patent No.: US 6,547,203 B1
(45) Date of Patent: Apr. 15, 2003

(54) RETRACTABLE ANCHORING DEVICE

(76) Inventor: Douglas Willard, 47 Alderway Ave., Brampton (CA), L6Y 2B8

( * ) Notice: Subject to any disclaimer, the term of this patent is extended or adjusted under 35 U.S.C. 154(b) by 0 days.

(21) Appl. No.: 10/014,444

(22) Filed: Dec. 14, 2001

(51) Int. Cl.[7] ..... F16M 13/00
(52) U.S. Cl. ..... 248/530
(58) Field of Search ..... 248/530, 545, 248/156, 188.5; 52/156; 135/16, 66, 118

(56) References Cited

U.S. PATENT DOCUMENTS

| | | | | |
|---|---|---|---|---|
| 4,162,789 A | * | 7/1979 | Hollaway | 52/157 X |
| 4,832,304 A | | 5/1989 | Morgulis | |
| 5,046,699 A | | 9/1991 | Perreault et al. | |
| 5,293,889 A | | 3/1994 | Hall et al. | |
| 5,396,916 A | | 3/1995 | Boissonnault | |
| 5,522,642 A | * | 6/1996 | Herzog | 248/188.5 X |
| 5,613,329 A | * | 3/1997 | Land et al. | 52/157 |
| 6,272,798 B1 | * | 8/2001 | Cockman | 52/157 X |
| 6,202,368 B1 | * | 3/2002 | Wallace, III | 52/157 |

OTHER PUBLICATIONS

US 2001/0035201 A1 to Kuzmic; Pub date Nov./2001, filed Mar./2001, effective filing date Apr./2000.*

* cited by examiner

*Primary Examiner*—Ramon O. Ramirez

(57) ABSTRACT

A retractable anchoring device comprising of a hollow tubular member an auger and a fastener. The retractable anchoring device may move from a retracted position in which the auger is within the hollow tubular member, to a protracted position where the auger is exposed and may be driven into the ground whereby the hollow tubular member can support shade providing device.

12 Claims, 3 Drawing Sheets

RETRACTABLE ANCHORING DEVICE

FIELD OF THE INVENTION

This invention relates generally to anchoring device and more particularly to a retractable anchoring device or auger in combination with a hollow post for an umbrella.

BACKGROUND OF THE INVENTION

There have been a variety of anchoring devices for posts that have been adapted for use with.umbrellas and more specifically beach umbrellas. The purpose of these anchoring devices is to allow a user to anchor the post into the ground and then attach the umbrella to the post freeing the user from having to hold the umbrella. Traditionally, these anchoring devices have been used for beach umbrellas and have therefore been used in the sand.

Today, there is a greater need for an anchoring device for use with an umbrella or other shade providing device as more and more family activities are conducted outside. Activities such as camping, baseball, softball and soccer often require shade that may be provided by an umbrella that can be anchored into the ground. The ground however can vary significantly from sandy soil to clay, so the umbrella must have an anchoring device that can pierce through different types of soil and that is strong enough to hold the umbrella.

Many of these activities also require that the user travel to a particular location to participate, and therefore the anchoring device must be handled along with the umbrella. Given the inherent awkward nature of the umbrella and the anchoring device, travelling with the device can often result in damage to surrounding objects and to the user themselves. Prior art anchoring devices have been devised to address some of the aforenoted problems.

For example, U.S. Pat. No. 5,293,889 to Hall issued Mar. 15, 1994 relates to a beach umbrella having a lowermost section assembled selectively with an intermediate and upper section, with the upper section including an umbrella canopy mounted thereto.

U.S. Pat. No. 5,046,699 to Perreault et al. issued Sep. 10, 1991 relates to an anchoring device for securing a post such as a beach umbrella into the ground and comprises of a hollow tubular member for vertically holding the post, a screw member at the lower end of the tubular member, a pair of laterally extending lever arms at the upper end of the tubular member for twisting the screw member and the tubular member and driving both into the ground.

U.S. Pat. No. 4,832,304 to Morgulis issued May 23, 1989 relates to a ground-anchoring device for anchoring a pole in the ground, comprising of a post formed with spiral threads at one end for threading into the ground; a socket at the opposite end for receiving an end of the pole to be anchored in the ground; and a pair of arms pivotally mounted at the opposite end of the post from a horizontal position facilitating the rotation of the post to thread it into the ground or to a vertical position.

U.S. Pat. No. 5,396,916 to Boissonnault issued Mar. 14, 1995 relates to a shading device including an umbrella-like canopy comprising of a collapsible frame and a flexible light-proof covering with an anchoring device for supporting the shade device above ground so that the canopy will serve as a sun shade, particularly for blocking the rays of the sun wherein the anchoring device including an offset support arm for overhanging the canopy and an anchoring helix adapted to be driven into the ground for providing support to the shading device.

Therefore, a retractable anchoring device for a post or umbrella that can be inserted into a variety of soil types, that has the strength to hold an umbrella, and can collapse or retract for easy traveling without causing damage is desirable.

SUMMARY OF THE INVENTION

An object of the present invention is to provide an improved retractable anchoring device used in combination with a post.

In accordance with one aspect of the invention, there is provided a retractable anchoring device comprising of a hollow tubular member that includes a proximal end, a distal end and an opening. The retractable anchoring device also includes an anchoring means that has a proximal end, a distal end, and a series of openings.

The anchoring means may move from a first retracted position within the hollow tubular member to a second protracted position thereby exposing the distal end of the anchoring means which may engage the ground. A fastening means may be adapted to fasten through the openings of both the hollow tubular member and the anchoring means so as to secure the retracted anchoring device in either the first retractable position or the second protracted position.

In accordance with still another aspect of the invention, there is provided a retractable anchoring device wherein the anchoring means is further defined as an auger that may move within a hollow tubular member or hollow post from a first retracted position to a second protracted position. In the second protracted position the distal end of the auger may be exposed so as to engage the ground and secure the auger and the hollow tubular to the ground.

Advantages of the present invention include the following: the auger is adapted to penetrate a variety of soils, including hard soils such as clay; the retractable anchoring device allows the user to store the anchoring means or auger within the device allowing for easy storage of the auger for traveling, while protecting other articles from damage from the distal end of the auger; improved strength and durability of the retractable anchoring device specifically in connection to the hollow tubular member or hollow post for an umbrella.

BRIEF DESCRIPTION OF DRAWINGS

A detailed description of a embodiment of the present invention is provided herein below by way of example only with reference to the following drawings, in which.

Figure 1:
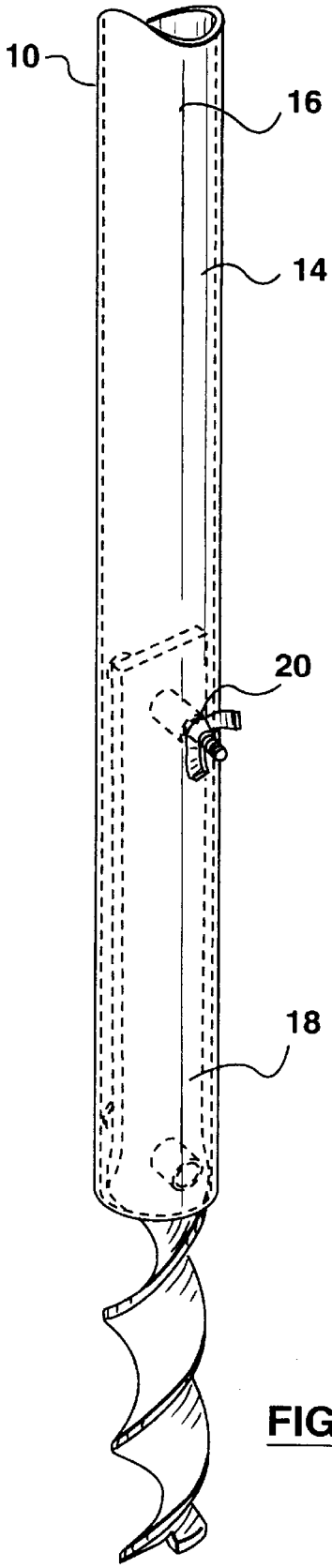
FIG. 1, in a perspective view, illustrates the retractable anchoring device in the protracted position in accordance with the present invention.

In the drawings, the embodiments of the invention are illustrated by way of example. It is to be expressly understood that the description and drawings are only for the purposes of illustration and as an aid to understanding, and are not intended as a definition of the limits of the invention.

DETAILED DESCRIPTION OF THE DRAWINGS

In the description which follows, like parts are marked throughout the specification and the drawings with the same reference numerals. The drawings are not necessarily to scale and in some instances proportions may have been exaggerated in order to more clearly depict certain features of the invention.

Figure 2:
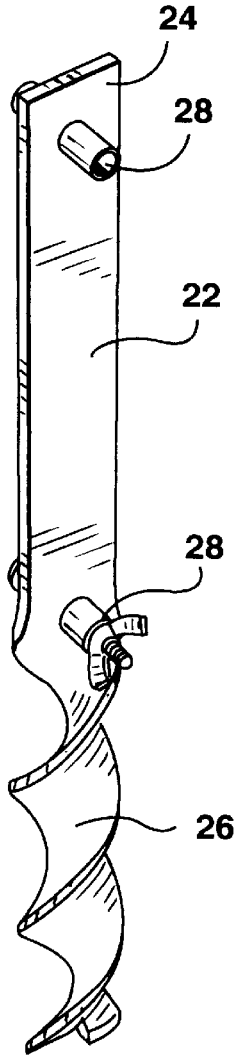
FIG. 2, in a perspective view, illustrates the anchoring means of the retractable anchoring device as described in FIG. 1.

Referring to FIGS. 1–2, there is illustrated in perspective views, a retractable anchoring device 10 in accordance with the preferred embodiment of the present invention. The retractable anchoring device 10 includes a hollow tubular member 14 having a proximal end 16, a distal end 18 and an opening 20.

Figure 3:
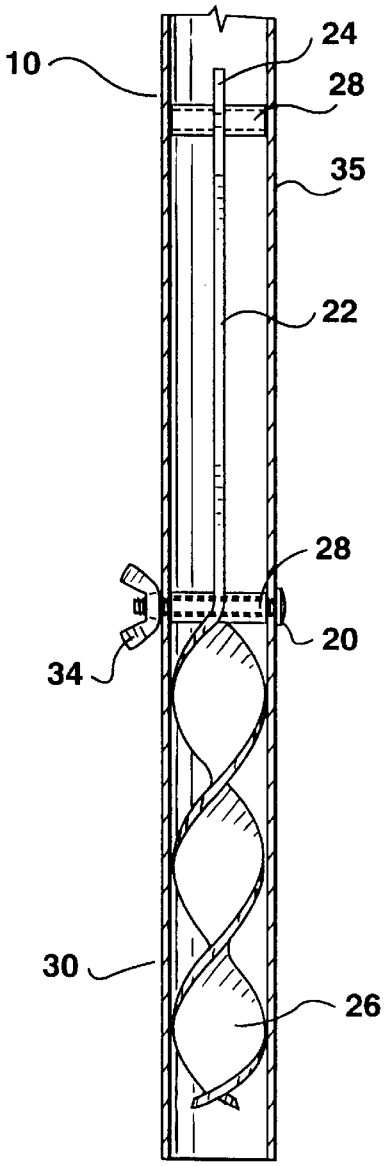
FIG. 3, in a cross-sectional view, illustrates the retractable anchoring device in the retracted position along the line 3—3.

Referring to FIG. 3, the retractable anchoring device 10 may further include an anchoring means 22 that may have a proximal end 24, a distal end 26 and a series of openings 28. The anchoring means 22 may sit within the hollow tubular member 14 when the retractable anchoring device 10 is in a first retracted position 30. The anchoring means 22 may move.to a second protracted position 32 whereby the distal end 26 of the anchoring means 22 extends beyond the distal end 18 of the hollow tubular member 14.

A fastening means 34 may be adapted to fasten through the opening 20 of the hollow tubular member 14 and through the series of openings 28 of the anchoring means thereby securing the retractable anchoring device 10 in either the first retracted position 30 or the second protracted position 32.

The hollow tubular member 14 may be further defined as a hollow metal tube or post 35 having, a hole 36 that passes through both sides of the hollow metal tube or post 35. The anchoring means 22 may be further defined as an auger 38 wherein the distal end 26 is helically shaped so as to easily drive the auger 38 into the ground. The series of openings 28 on the anchoring means 22 may be defined as passages 40 at both the proximal and distal ends (24 and 26 respectively) of the anchoring means 22, that can coincide or match up with the hole 36 on the hollow metal tube 35. The fastening means 34 may be further defined as a spring pin 42 and a bolt and nut assembly 43 that may pass through the hole 36 on the hollow metal tube 35, pass through the passage 40 and then through the hole 36 on the other side of the hollow metal tube 35, Referring to FIGS. 3 and 4, in operation the retractable anchoring device 10 may be assembled so that the hollow tubular member 14i may include an umbrella or other shade providing device.

In the first retracted position 30, the anchoring means 22 rests within the hollow tubular member 14. The anchoring means 22 is secured in.the first retracted position by securing the fastening means 34 through the hole 36 at of the hollow tubular member 14, and through the passage 40 at the distal end 26 of the anchoring means 22. The position of the hole 36 on the hollow tubular member 16 is relative to location of the passage 40 on the anchoring means 22, as the distal end 26 of the anchoring means 22 must be enclosed within the hollow tubular member 14. In general the location of the hole 36 on the hollow tubular member 14, must be at least the distance from the distal end 26 of the anchoring means 22 to the passage 40 located at the distal end 26 of the anchoring means 22.

The retractable anchoring.device 10 may move to the second protracted position 32 by unfastening the fastening means 34 and moving or sliding the anchoring means 22 out of the hollow tubular member 14 so that the distal end 26 of the anchoring means 22 is exposed, The anchoring means 22 may be secured by placing the fastening means 34 through the hole 36 on the hollow tubular member 14 and passage 40 at the proximal end 24 of the anchoring means 22, and through the hole 36 on the other side of the hollow tubular member 14. In the second protracted position 32, the distal end 26 of the anchoring means 22 which is helically shaped, is exposed and therefore may be driven into the ground using a twisting motion. The retractable anchoring device 10 may be twisted into the ground so that even the hollow tubular member 14 is partially underground providing additional support to the shading device or umbrella. The hollow tubular member 14 may follow the anchoring means 22 into the ground as the hole the anchoring means 22 creates will allow the hollow tubular member 14 to fit snugly into the hole.

The retractable anchoring device 10 may be removed from the ground and moved to the first retracted position 30 by unfastening the fastening means 34 and allowing the anchoring means 22 to slide towards the proximal end 16 of the hollow tubular member 14 and securing the fastening means 34 as described above. Hollow tubular members 14 and anchoring means 22 may come in a variety of diameters depending on the requirements for the shading device.

Figure 4:
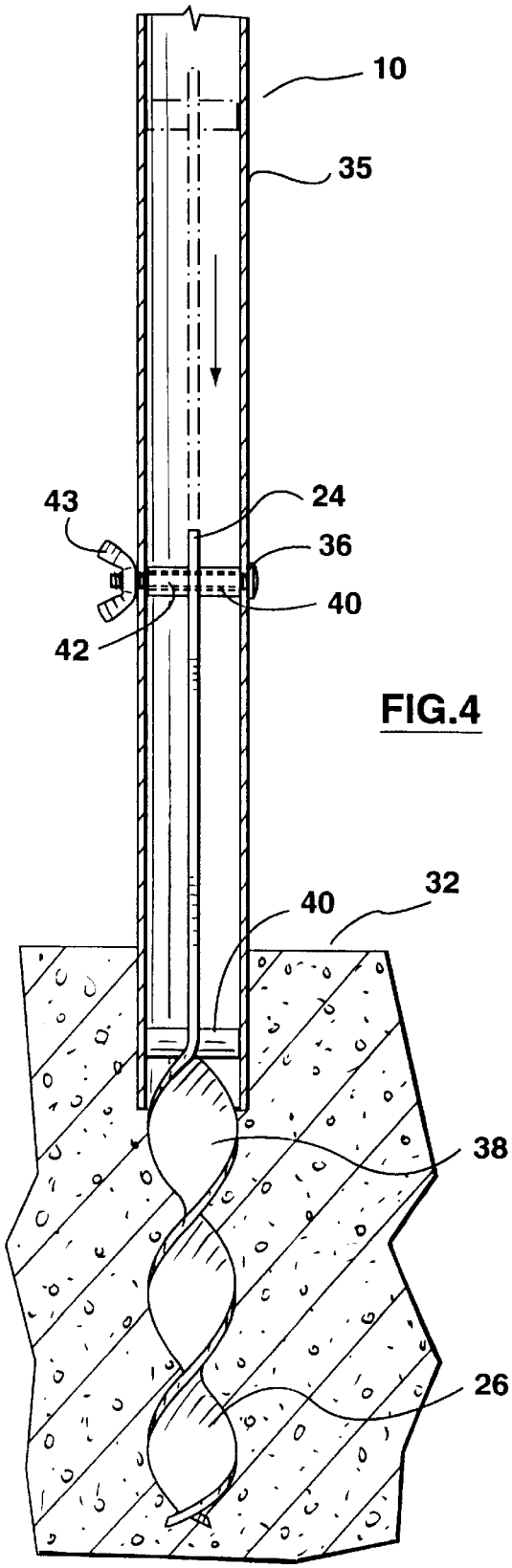
FIG. 4, in a cross-sectional view, illustrates the retractable anchoring device in the protracted position.
Figure 5:
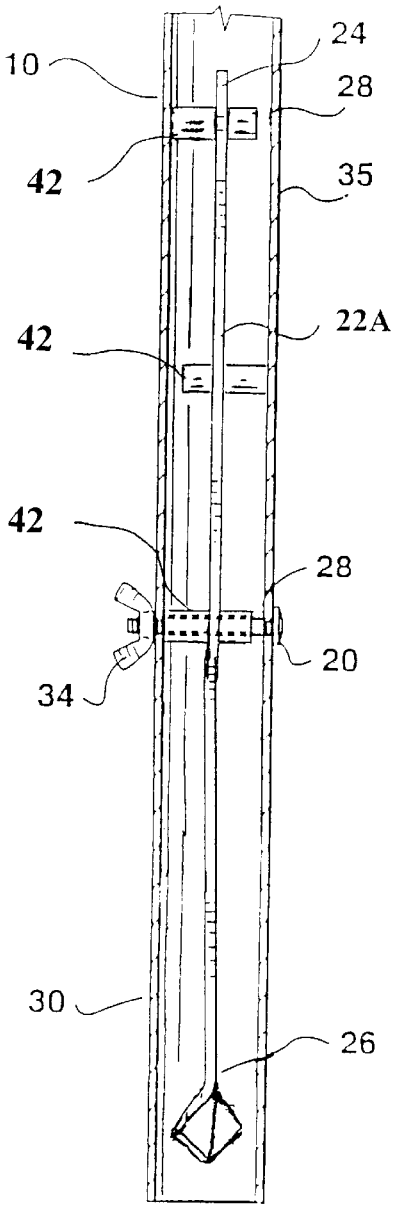
FIG. 5, in a cross-sectional view, illustrates an alternative embodiment of the present invention, having a shortened anchoring device, in a retracted position.
Figure 6:
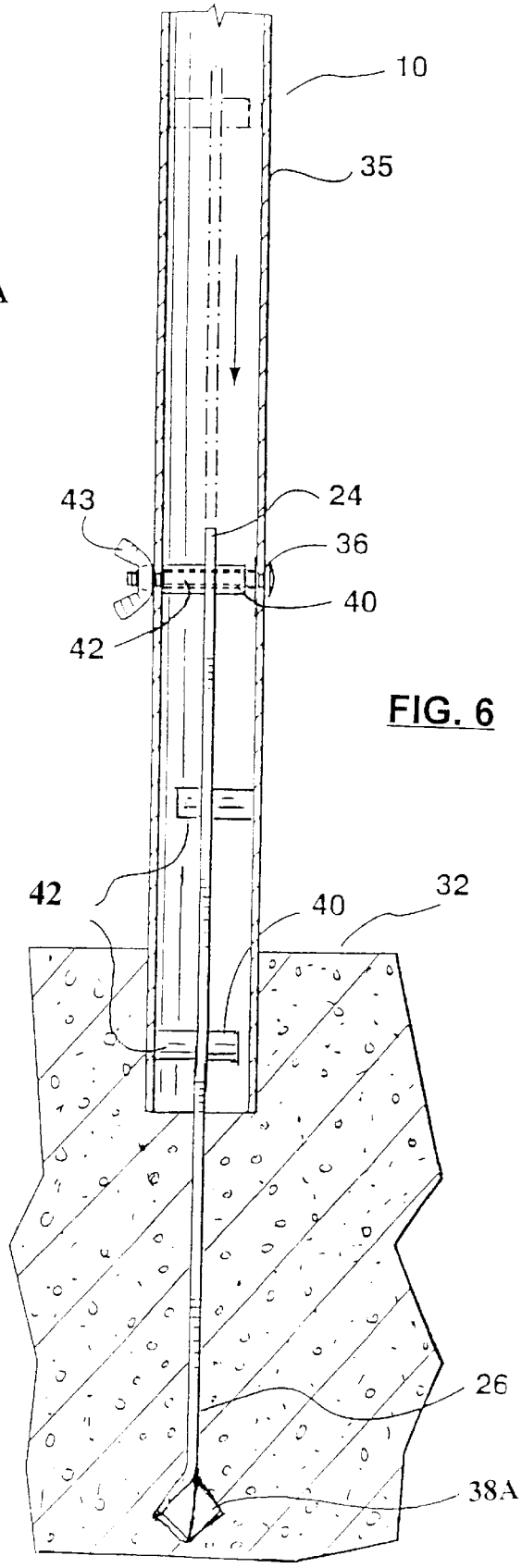
FIG. 6, in a cross-sectional view, illustrates the anchoring device of FIG. 5 in a protracted position.

Referring to FIGS. 5 and 6, there is illustrated an alternative embodiment of the present invention wherein the helical section of auger 38A has been shortened, although the overall length of the anchoring means 22A remains essentially constant. Under certain soil conditions, the shortened helical section of auger 38A facilitates insertion of the anchoring device into the ground while still providing adequate support for the umbrella or other such device. The other details from FIGS. 3 and 4 are identical to this embodiment.

Also, in FIGS. 5 and 6, an additional passage 40 has been shown, which creates an additional opening 28. This additional passage provides for an intermediate protracted position, in situations where full protraction of the anchoring means 22A is not required. As such, control of the length that the anchoring device member extends beyond the end of the hollow metal tube 35, can be controlled. Additional passages might be added for even further control of the protracted length of the anchoring means 22A. As such, the present invention also provides an embodiment wherein the anchoring device member comprises a series of openings, and preferably at least 2 or 3 openings.

As previously stated, the passages 40 are preferably formed by use of spring pins 42, which are essentially "C-shaped" which can be forced into a hole which passes through the main body of the anchoring device member. The resilient fit of the spring pin into the member holds the pin in position. However, the exact depth of insertion of the spring pin into the hole may be adjusted by applying force to insert the pin further into the hole.

In a preferred embodiment, the anchoring device member comprises at least 3 such spring pins. With this number of pins, the depth of insertion of the pins can be adjusted and offset on each side of the anchoring device member so as to adjust the overall width of the anchoring device member. For example, as shown in FIGS. 5 and 6, spring pins 42 are shown in an offset arrangement wherein the middle spring pin 42 is offset in the opposite direction of the upper and lower spring pins. This provides the user with the ability to control the width of the anchoring device member, and thus adapt the width of the member so that it will fit into a wide variety of hollow tube diameters, while still providing a snug fit.

A snug fit is desirable since it provides a much more solid anchoring solution than a loose fit.

Various embodiments of the invention have now been described in detail. Since changes in and/or additions to the above-described best mode may be made without departing from the nature, spirit or scope of the invention, the invention is not to be limited to said details.

It is therefore apparent that there has been provided, in accordance with the present invention, a retractable anchoring device which fully satisfies the means, objects, and advantages set forth hereinbefore. Having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

What is claimed is:

1. A retractable anchoring device comprising:

a hollow tubular member that includes a proximal end, and a distal end;

an anchoring device member which includes a proximal end, and a distal end; and fastening means adapted to fasten said anchoring device member in place, so as to secure the anchoring device member in either a retracted position wherein said anchoring device member is held completely within said hollow tubular member, or a protracted position wherein at least said distal end of said anchoring device member extends beyond the distal end of said hollow tubular member; and wherein said anchoring device member is adapted to be moved from said retracted position to said protracted position, so that said distal end is accessible in order to be inserted into the ground and thereby hold said hollow tubular member in place.

2. A retractable anchoring device as claimed in claim 1 wherein said hollow tubular member comprises at least one opening, said anchoring device member comprises at least one opening, and said fastening means is inserted through the openings of both the hollow tubular member and the anchoring device member, in order to hold the anchoring device member in either said retracted or protracted position.

3. A retractable anchoring device as claimed in claim 2 wherein said fastening means is a nut and bolt, or a pin, which is inserted through said openings in said hollow tubular member and said anchoring device member.

4. A retractable anchoring device as claimed in claim 2 wherein said anchoring device member comprises a series of openings.

5. A retractable anchoring device as claimed in claim 1 wherein said distal end of said anchoring device member is at least partially helically shaped and is thus adapted to be twisted into the ground.

6. A retractable anchoring device as claimed in claim 5 wherein said distal end of said anchoring device member is in the shape of an auger.

7. A retractable anchoring device as claimed in claim 1 wherein said anchoring device is held completely inside of said hollow tubular member when said anchoring device is in said retracted position.

8. A retractable anchoring device as claimed in claim 1 wherein said hollow tubular member forms part of, or is attached to, an umbrella.

9. An anchoring device member adapted for use in a hollow tubular member which tubular member has a proximal end and a distal end, in order to create a retractable anchoring device, wherein said anchoring device member comprises:

a support body having a proximal end, and a distal end; and fastening means adapted to fasten said anchoring member device in place, so as to secure the anchoring device member in either: i) a retracted position inside said tubular member, wherein said anchoring device member is held completely within said hollow tubular member; or ii) a protracted position wherein at least said distal end of said anchoring device member extends beyond the distal end of said hollow tubular member; and wherein said anchoring device member is adapted to be moved from said retracted position to said protracted position, so that said distal end is accessible in order to be inserted into the ground and thereby hold said hollow tubular member in place.

10. A retractable anchoring device comprising:

a hollow tubular member that includes a proximal end, a distal end, and at least one opening;

an anchoring device member which includes a proximal end, a distal end, spring pins, and a series of openings created by a central passage through said spring pins; and fastening means adapted to fasten said anchoring device member in place, so as to secure the anchoring device member in either a retracted position wherein said anchoring device member is held essentially completely within said hollow tubular member, or a protracted position wherein at least said distal end of said anchoring device member extends beyond the distal end of said hollow tubular member;

wherein said anchoring device member is adapted to be moved from said retracted position to said protracted position, so that said distal end is accessible in order to be inserted into the ground and thereby hold said hollow tubular member in place, and wherein said fastening means is inserted through the openings of both the hollow tubular member and the anchoring device member, in order to hold the anchoring device member in either said retracted or protracted position.

11. A retractable anchoring device as claimed in claim 10 wherein said anchoring device member has at least 3 spring pins.

12. A retractable anchoring device as claimed in claim 11 wherein said spring pins are offset in distance from said anchoring device member, so as to provide a snug fit into said hollow tubular member.

* * * * *